US007270159B2

(12) United States Patent
Burns

(10) Patent No.: US 7,270,159 B2
(45) Date of Patent: Sep. 18, 2007

(54) SPILLESS FUNNEL

(76) Inventor: Lawrence C. Burns, 36 N. Main St., Old Saybrook, CT (US) 06475-4422

( * ) Notice: Subject to any disclaimer, the term of this patent is extended or adjusted under 35 U.S.C. 154(b) by 0 days.

(21) Appl. No.: 11/273,386

(22) Filed: Nov. 14, 2005

(65) Prior Publication Data

US 2006/0144465 A1 Jul. 6, 2006

Related U.S. Application Data

(60) Provisional application No. 60/641,637, filed on Jan. 5, 2005.

(51) Int. Cl.
*B65B 39/00* (2006.01)

(52) U.S. Cl. ..... 141/342; 141/340; 141/341; 141/333; 116/227; 73/294

(58) Field of Classification Search ..... 141/297, 141/303, 331–345; 73/293, 294; 116/227
See application file for complete search history.

(56) References Cited

U.S. PATENT DOCUMENTS 2,190,027 A * 2/1940 Jordan ..... 116/227
2,366,529 A * 1/1945 Hoff ..... 141/106
2,649,966 A * 8/1953 Johnston ..... 210/86
2,689,651 A 9/1954 Horsdal
3,630,083 A 12/1971 Gorans
4,353,252 A * 10/1982 Jeans ..... 83/293
4,901,776 A 2/1990 Attinello
4,997,013 A * 3/1991 Peckels ..... 141/95
5,259,535 A 11/1993 Boyte, Sr.
5,377,728 A * 1/1995 McLeighton ..... 141/333
6,109,313 A * 8/2000 Phelps ..... 141/106

* cited by examiner

*Primary Examiner*—Timothy L. Maust
(74) *Attorney, Agent, or Firm*—James Ray & Assoc.

(57) ABSTRACT

A funnel apparatus for aiding in filling containers, such as gasoline tanks on lawnmowers and similar items, with a liquid material. The funnel apparatus comprises a main body member having a first predetermined shape. There is a throat member having a second predetermined shape and connected to a bottom portion of the main body member for insertion into such container to be filled. A pair of adjustable stabilizing legs are engageable with the main body member for preventing the funnel apparatus from tipping over during filling. The adjustable stabilizing legs are disposed in spaced apart relationship. There is also an indicating means engageable with at least one of the main body member and the throat member for indicating what level such liquid being added to such container is at.

21 Claims, 8 Drawing Sheets

SPILLESS FUNNEL

CROSS REFERENCE TO RELATED APPLICATIONS

This application is closely related to and claims benefit from U.S. Provisional Application Ser. No. 60/641,637 filed Jan. 5, 2005.

FIELD OF THE INVENTION

The present invention relates, in general, to a funnel for use with pouring a liquid into a container, and, more specifically the present invention relates to a spilless funnel which provides a stable platform and a fill indicator for filling top-opening containers.

BACKGROUND OF THE INVENTION

The conventional funnel is inherently unstable and in many instances causes the overflow of liquid that is being poured. This is a problem that occurs quite frequently, for example, with top loading gas tanks for internal combustion engines. Some examples of these would be lawn mowers, leaf blowers, lawn tractors and garden cultivators.

Refueling a hot engine can be very dangerous and can cause the gasoline to ignite and to possibly explode. The directions on most of these engines give a warning about filling a hot engine; however, most users do not want to wait till the engines cools sufficiently and thereby remove the danger but want to continue working without waiting and will refill the engine while it is still hot. This can result in damage to the engine and/or to the operator.

In addition to the unstable characteristics of conventional prior art funnels, the user cannot see when the container (gas tank) is nearly full without stopping the refueling process and removing the funnel to check the fluid level in the tank. This also can lead to gasoline spills as the gasoline overflows from an overfilled gas tank.

Thus, it would be advantageous if a funnel were available that could eliminate most of the problems encountered with refueling a gasoline engine.

SUMMARY OF THE INVENTION

Thus, the present invention provides a funnel apparatus for aiding in filling containers, such as gasoline tanks on lawnmowers and similar items, with a liquid material. The funnel apparatus comprises a main body member having a first predetermined shape and constructed of a preselected material. There is a throat member having a second predetermined shape and connected to a bottom portion of the main body member for insertion into such container to be filled. A pair of adjustable stabilizing legs are engageable with the main body member for preventing the funnel apparatus from tipping over during filling. The adjustable stabilizing legs are disposed in spaced apart relationship and there is an indicating means engageable with at least one of the main body member and the throat member for indicating what level such liquid being added to such container is at.

OBJECTS OF THE INVENTION

It is, therefore, one of the primary objects of the present invention to provide a funnel which is spilless.

Another object of the present invention is to provide a funnel which has an indicator to show when the container reaches the full level.

It is an object of the present invention that the indicating means can be either mechanical or visual.

Still another object of the present invention is to provide a funnel which provides a stable platform for filling top-opening containers.

Yet another object of the present invention is to provide a plug system to prevent overflow.

It is another object of the present invention to provide a funnel which has a stabilizing collar surrounding the funnel spout.

It is, yet, another object of the present invention to provide a funnel which utilizes plum line arrows for assuring that the funnel is mounted in the container correctly.

These and various other objects and advantages of this invention will become apparent after a full reading of the following detailed description, particularly, when read in conjunction with the attached drawings as described below and the appended claims.

Figure 1:
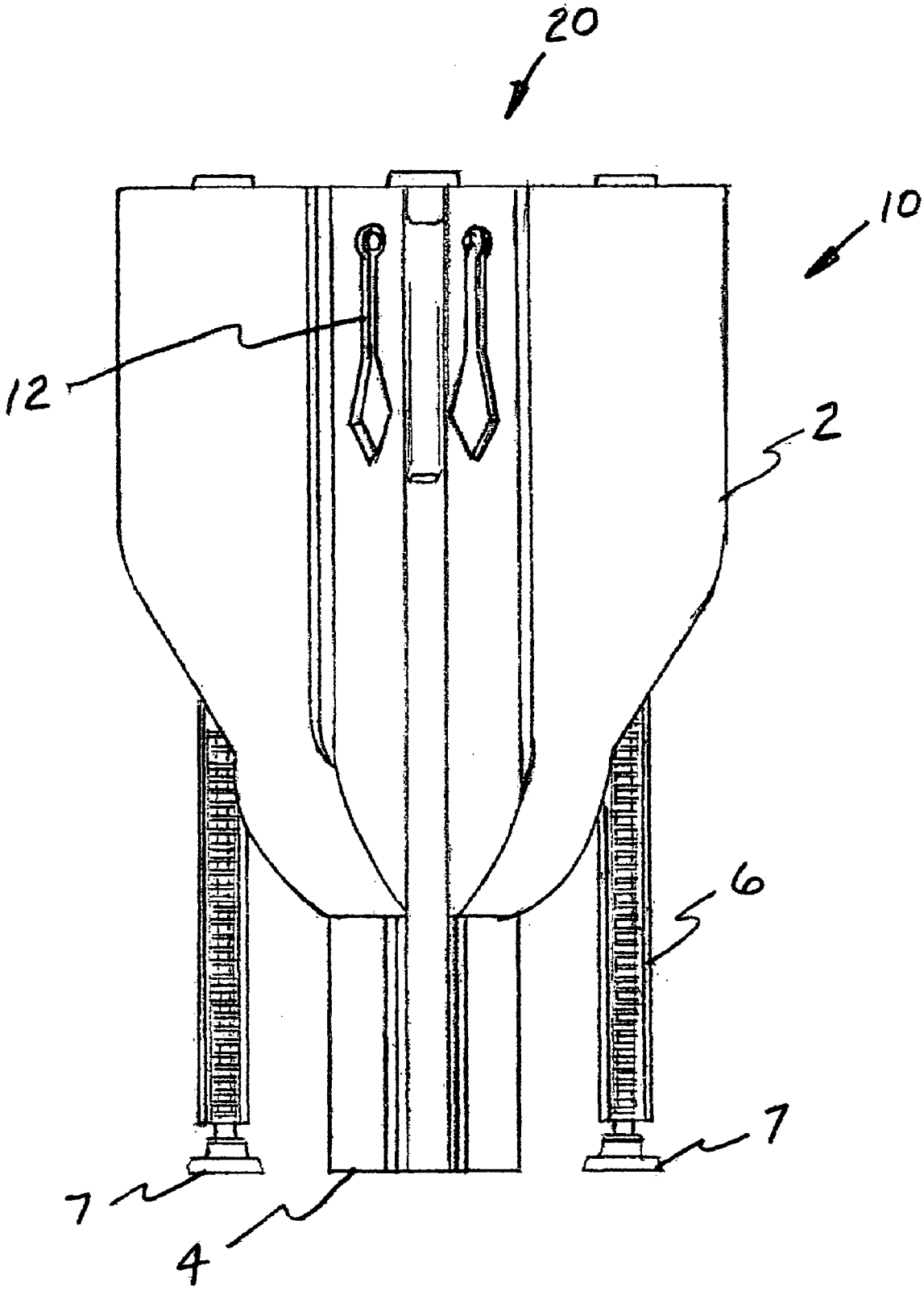
FIG. 1 is a front view of a funnel apparatus according to an embodiment of the present invention.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Thus, the present invention provides a funnel apparatus, generally designated 10, for aiding in filling containers (not shown), such as gasoline tanks on lawnmowers, leaf blowers, lawn tractors, garden cultivators and other similar items, with a liquid material. In the case of these items such liquid material would be gasoline. Although such funnel apparatus 10 may have a variety of applications most of the following discussion will be in relation to it's use in filling gasoline tanks. The funnel apparatus 10 comprises a main body member 2 having a first predetermined shape and constructed of a preselected material. There is a throat member 4 having a second predetermined shape and connected to a bottom portion of the main body member 2 for insertion into such container to be filled. A pair of adjustable stabilizing legs 6 are engageable with the main body member 2 for preventing the funnel apparatus 10 from tipping over during filling. Such adjustable stabilizing legs 6 have a base member 7 for engagment with such container to be filled so as to provide stability for the apparatus 10. It is presently preferred that such base member 7 is suction cup.

These adjustable stabilizing legs 6 are disposed in spaced apart relationship and there is an indicating means, generally designated 20, engageable with at least one of the main body member 2 and the throat member 4 for indicating what level such liquid being added to such container is at.

It should be noted that such throat member 4 is sufficiently large to prevent back filling of said funnel apparatus 10 and thereby preventing spillage.

As illustrated in the drawing Figures it can be seen that the predetermined shape the main body member 2 is substantially circular. Such predetermined shape of the main body member 2 further includes a pair of spaced apart recessed apertures 8 for engaging the pair of adjustable stabilizing legs 6. It should further be noted that such pair of adjustable stabilizing legs 6 allows for the use of the funnel apparatus 10 with non level containers, such as non-level gas tanks. There is a third recessed aperture 9 on main body member 2 for engagement with such indicating means 20. The recessed apertures 8 and 9 may have different shapes; however it is presently preferred that such recessed apertures 8 be substantially triangular while aperture 9 is substantially round. It is also preferred that such stabilizing legs 6 also be formed in a triangular fashion so as fit properly in the recessed apertures 8.

Figure 2:
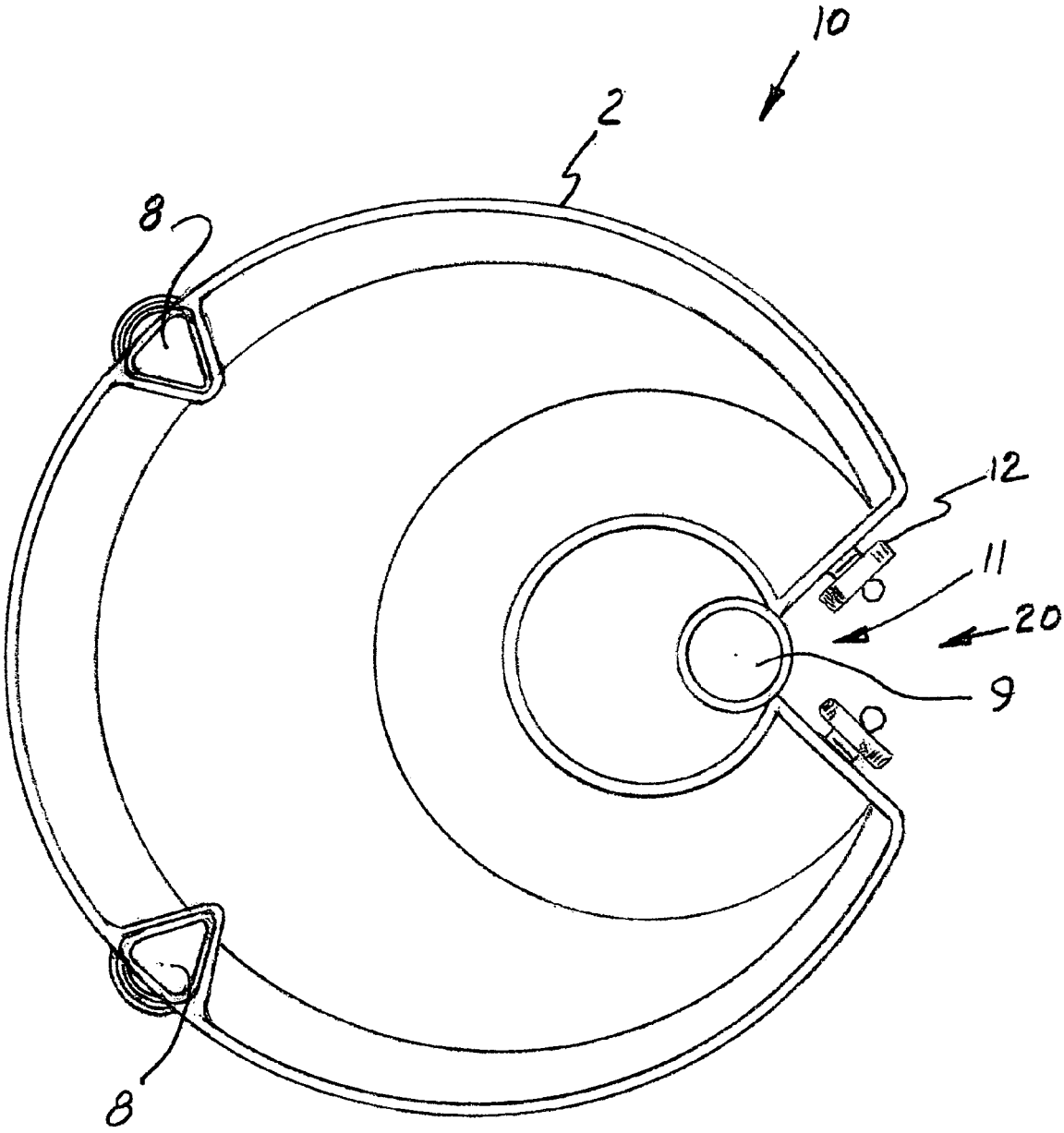
FIG. 2 is a top view of the funnel apparatus shown in FIG. 1.
Figure 3:
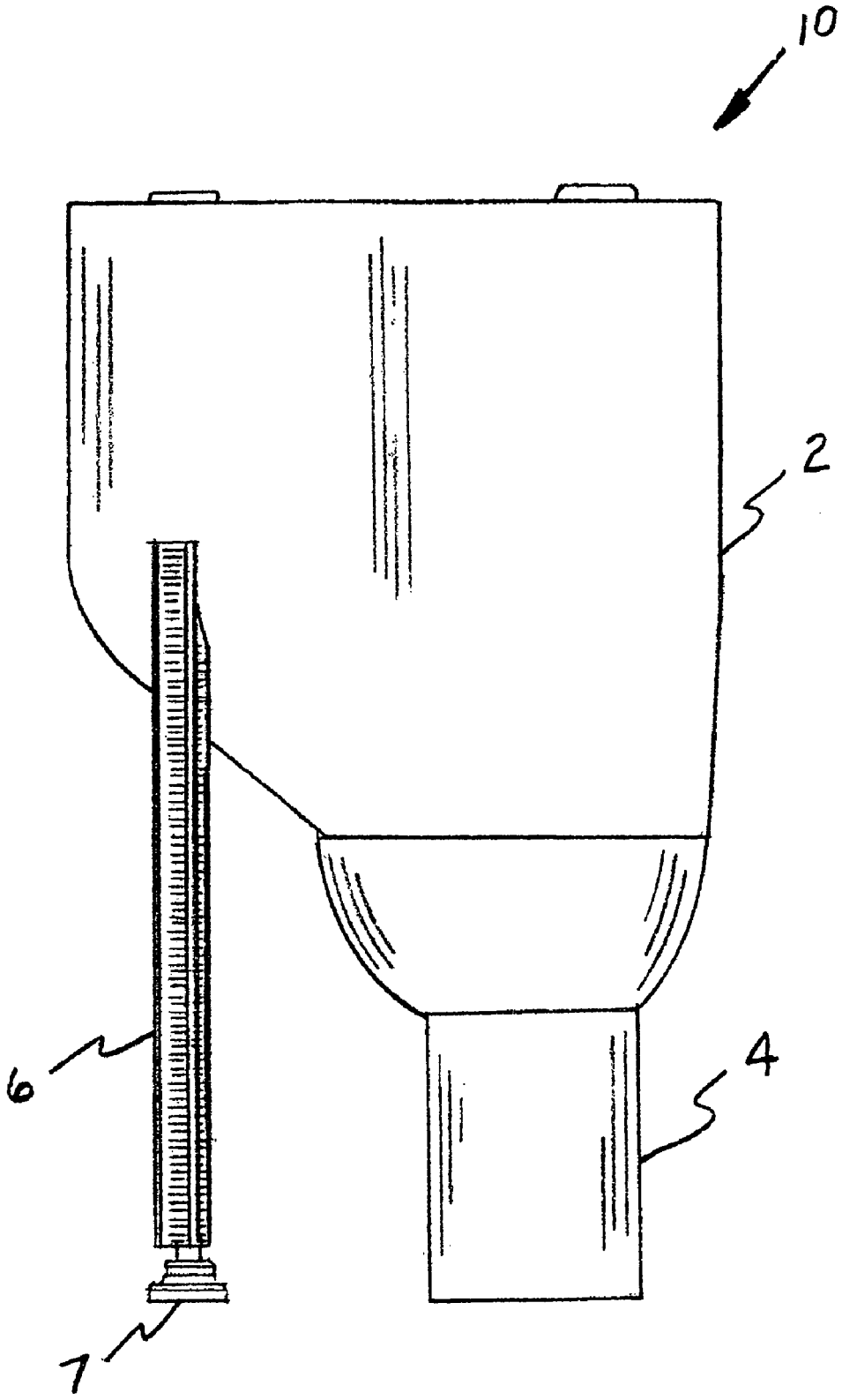
FIG. 3 is a side view of a funnel apparatus according to the embodiment shown in FIGS. 1-2.
Figure 4:
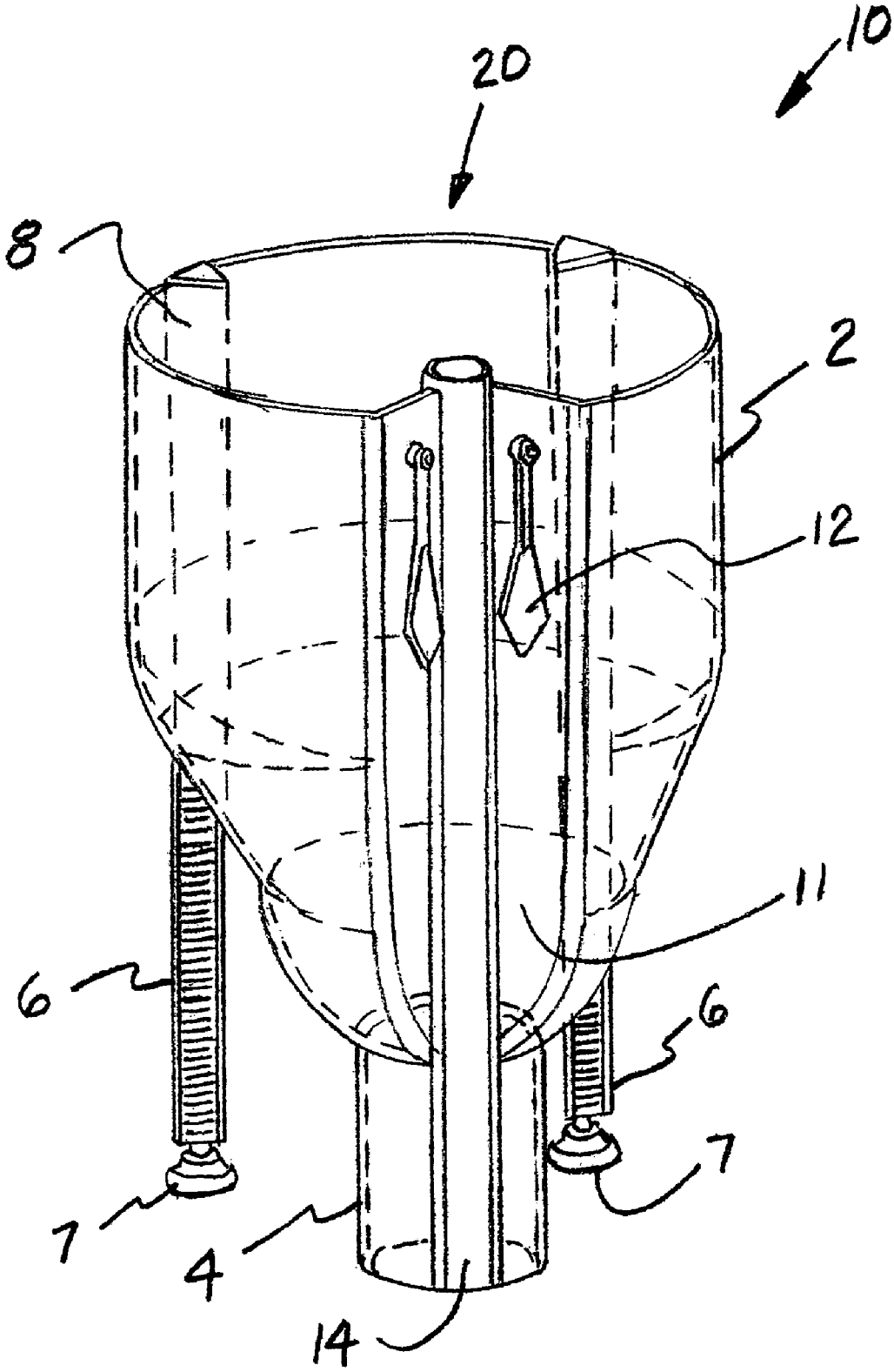
FIG. 4 is a front partial perspective see through view of the funnel apparatus according to an embodiment of the present invention shown in FIGS. 1-3.
Figure 5:
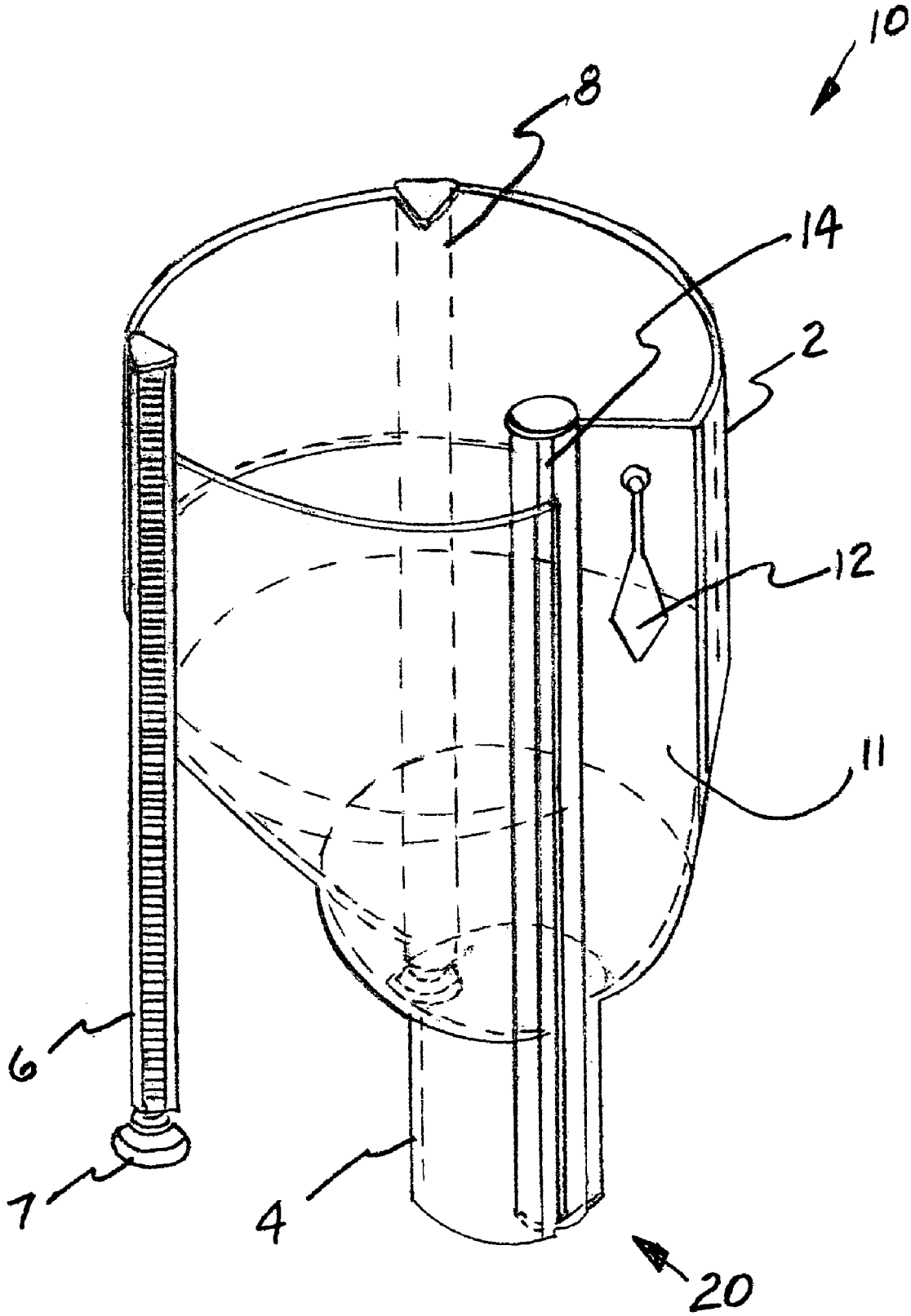
FIG. 5 is a side partial perspective see through view of the funnel apparatus according to an embodiment of the present invention shown in FIGS. 1-4.

As is clearly seen in FIGS. 2 and 3 such throat member 4 is offset with respect to the main body member 2. The throat member 4 being closely adjacent an outer periphery of the main body member 2 rather than being centered under the main body member 2. The outer periphery of the main body member 2 under which such throat member 4 is disposed is diametrically opposite the outer periphery of the main body member 2 that is a midpoint between the pair of adjustable stabilizing legs 6. Thus, when the throat member is positioned in the opening of a tank, which in many cases is disposed closed to an outer edge of the tank, the two stabilizing legs 6 can both sit on the top of the tank to provide stability for the funnel 10.

The main body member 2 may also include a recessed portion 11. It is also preferred that such recessed portion 11. be substantially triangular in shape. Such recessed aperture 9 would be disposed at an inner portion of such recessed portion 11.

The main body member 2 further includes at least one plum line arrow 12 disposed on an upper portion of the main body member 2 and within recessed portion 11 for assuring that the funnel apparatus 10 is mounted correctly in such container. It is presently preferred that there are two such plum line arrows 12.

Such indicating means 20 may be mechanical or visual and such indicating means may be made of either plastic or glass. In a presently preferred embodiment of the invention such indicating means 20 is a glass rod 14. In this embodiment of the invention such glass rod 14 will change color when gasoline reaches a bottom of the glass rod 14 thereby indicating the level of the gasoline in the tank.

Such preselected material for forming the main body member 2 is selected from one of stainless steel, galvanized metal and plastic. It is presently preferred that such material is plastic and that such plastic is compatible with gasoline and will not degrade over time. Presently it is preferred that such plastic is polypropylene.

Figure 6:
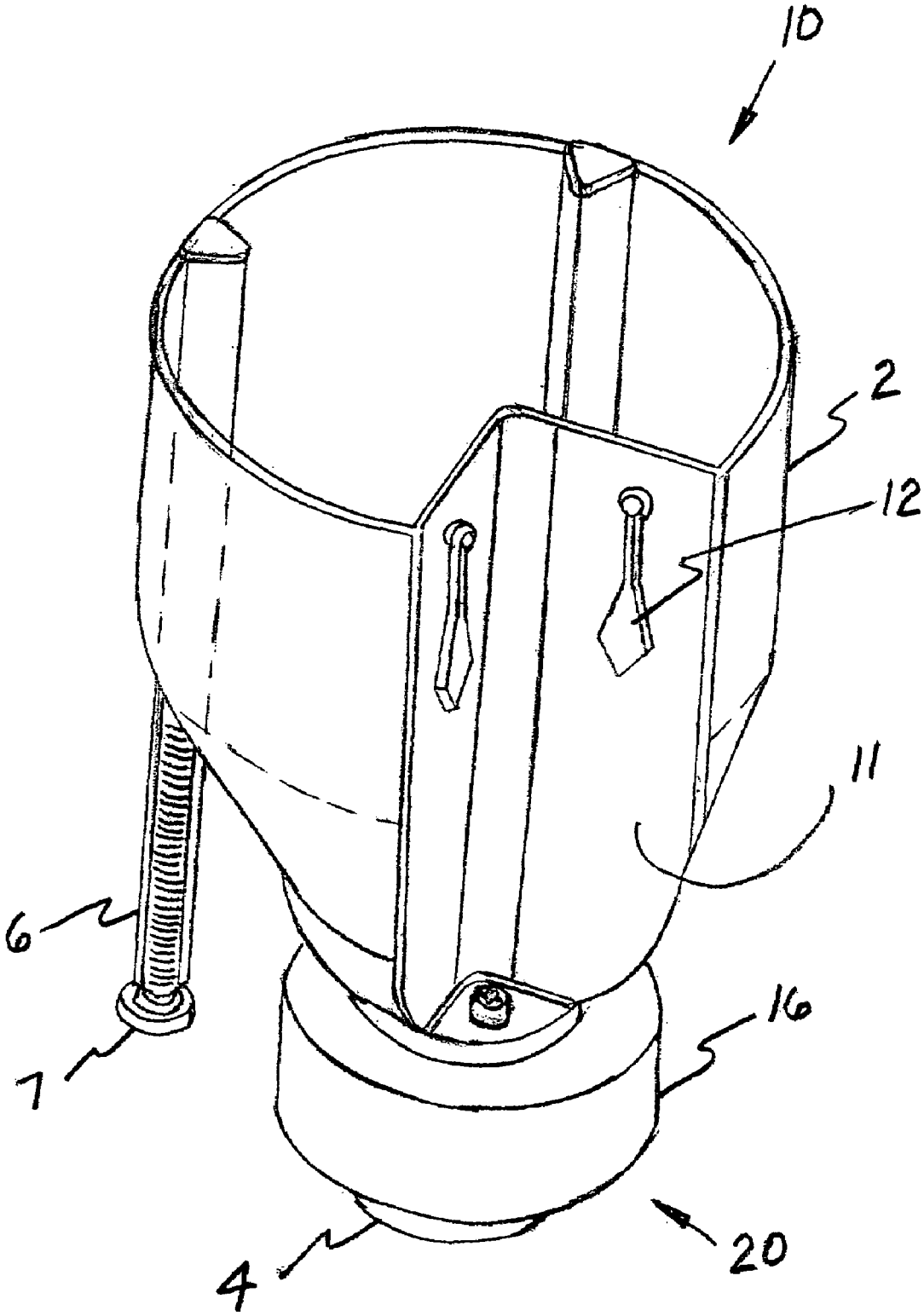
FIG. 6 is a partial perspective side view of a funnel apparatus according to an alternate embodiment of the invention.
Figure 7:
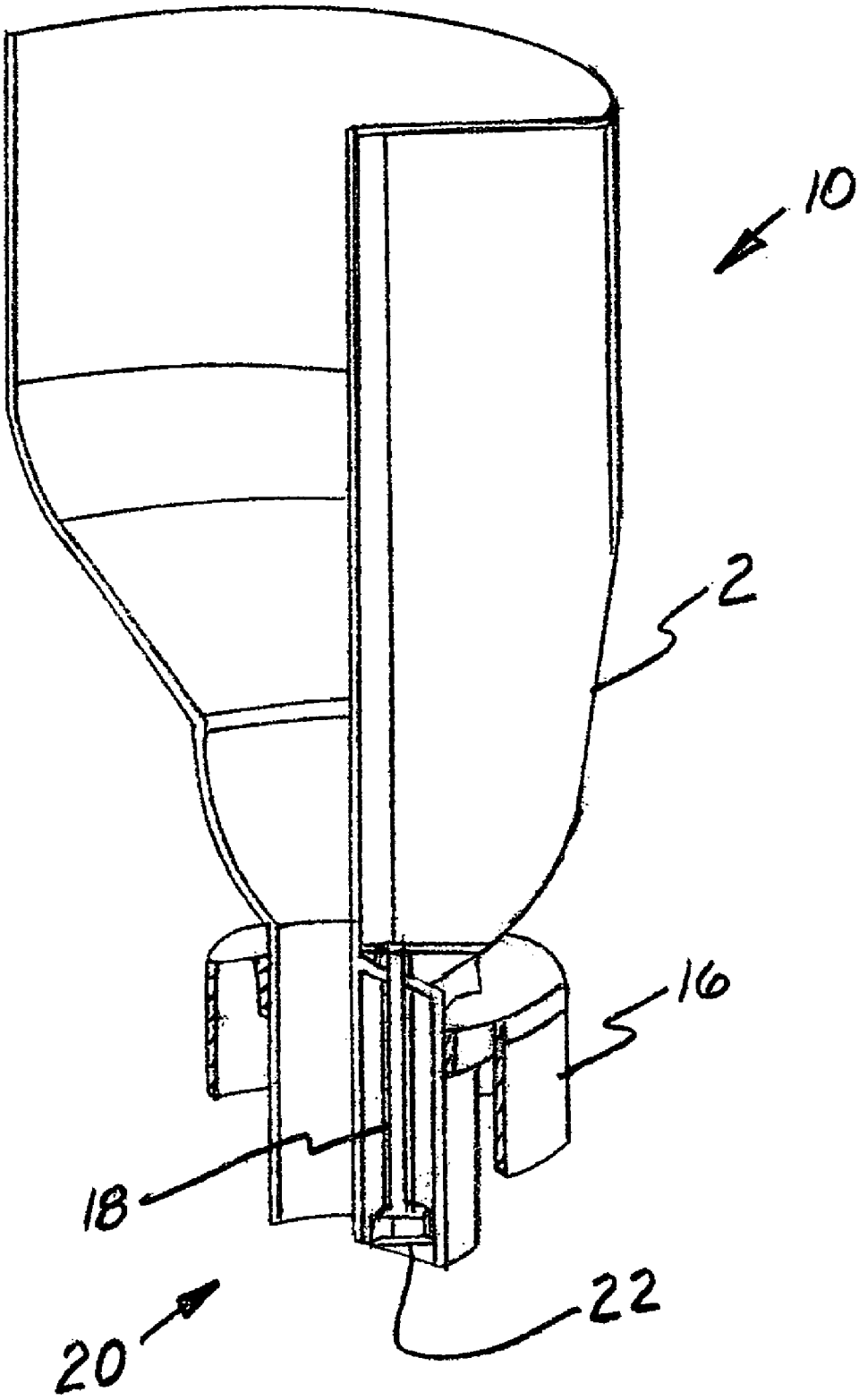
FIG. 7 is a partial perspective cutaway view of the funnel apparatus showing the mounting collar according to an alternate embodiment of the present invention.
Figure 8:
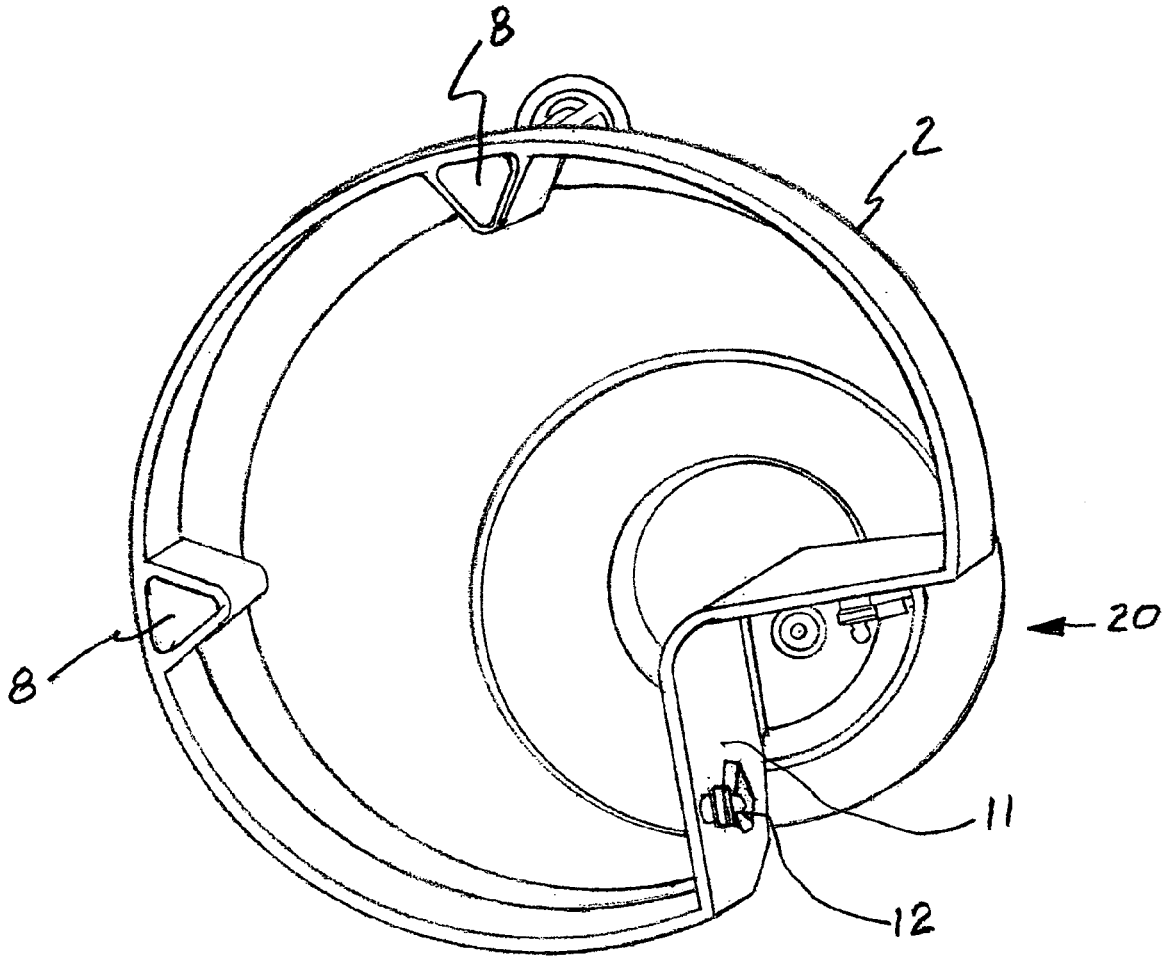
FIG. 8 is a partial perspective view of a funnel apparatus looking down from the top of the funnel according to the embodiment shown in FIGS. 6 and 7.

In an alternate embodiment of the invention, as seen in FIGS. 6-8, such funnel apparatus 10 further includes a mounting collar 16 surrounding the throat member 4 to assure that such funnel apparatus 10 is correctly mounted in such container. It is presently preferred that such collar is made of rubber. It is not necessary that the collar 16 be compatible with gasoline since gasoline should never come in contact with such collar 16. Such collar 16 comes in several sizes since the opening on gasoline tanks can vary and since the collar 16 merely slides on and off and is essentially interchangeable it is easy to change the collar 16 to fit the different gasoline tanks.

Also illustrated in FIGS. 6-8 is an indicating means 20 which uses a mechanical method for indicating the level of gasoline. The mechanical method uses a plastic rod 18 with a float casting 22 attached thereto. The casting 22 will float when the gasoline reaches the bottom of the float 22 causing the float to rise thereby indicating that the gasoline has reached a high level. It is presently preferred that such plastic utilized for the rod 18 and float 22 be made of polyurethane.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. A funnel apparatus for aiding in filling containers with a liquid material, said funnel apparatus comprising:

(a) a main body member having a first predetermined shape and constructed of a first preselected material;

(b) a throat member having a second predetermined shape and constructed of a second preselected material, said throat member connected to a bottom portion of said main body member for insertion into such container to be filled, said throat member being offset relative to said main body member, said throat member being closely adjacent an outer periphery of said main body member;

(c) a pair of adjustable stabilizing legs engageable with said main body member for preventing said apparatus from tipping over during filling, said adjustable stabilizing legs disposed in spaced apart relationship;

(d) an indicating means engageable with at least one of said main body member and said throat member for indicating what level such liquid being added to such container is at; and wherein said body member further includes at least one plumb line arrow disposed on an upper portion of said main body member for assuring that said funnel apparatus is mounted correctly in such container.

2. The funnel apparatus, according to claim 1, wherein said throat member is sufficiently large to prevent back filling of said funnel apparatus thus preventing spillage.

3. The funnel apparatus, according to claim 1, wherein said predetermined shape of said main body member is substantially circular.

4. The funnel apparatus, according to claim 3, wherein said predetermined shape of said main body member further includes a pair of spaced apart recessed apertures for engaging said pair of adjustable stabilizing legs.

5. The funnel apparatus, according to claim 1, wherein said throat member further includes a mounting collar surrounding said throat member to assure that such funnel apparatus is correctly mounted in such container.

6. The funnel apparatus, according to claim 1, wherein said at least one plumb line arrow is two.

7. The funnel apparatus, according to claim 1, wherein said pair of adjustable stabilizing legs allows for use of said funnel apparatus with non level containers.

8. The funnel apparatus, according to claim 1, wherein said indicating means is one of mechanical and visual.

9. The funnel apparatus, according to claim 8, wherein said visual indicating means is a glass rod.

10. The funnel apparatus, according to claim 9, wherein said glass rod will change color when gasoline reaches a bottom of said glass rod.

11. The funnel apparatus, according to claim 1, wherein said preselected material is selected from one of stainless steel, galvanized metal and plastic.

12. The funnel apparatus, according to claim 11, wherein said first and said second preselected material is plastic.

13. The funnel apparatus, according to claim 12, wherein said plastic used in manufacturing said funnel apparatus is compatible with gasoline and will not degrade over time.

14. The funnel apparatus, according to claim 13, wherein said plastic used in manufacturing said funnel apparatus is polypropylene.

15. The funnel apparatus, according to claim 8, wherein said mechanical indicating means includes a rod and a float casting.

16. The funnel apparatus, according to claim 15, wherein said rod and said float casting of said mechanical indicating means is made of plastic.

17. The funnel apparatus, according to claim 16, wherein said plastic is polyurethane.

18. The funnel apparatus, according to claim 15, wherein said rod and said float casting will float and cause said rod to rise when gasoline reaches a predetermined height in such container.

19. The funnel apparatus, according to claim 8, wherein said mechanical indicating means is disposed in a recessed aperture in said throat portion.

20. The funnel apparatus, according to claim 7, wherein said stabilizing legs have a base member disposed at an end of said stabilizing legs for engagement with such container to be filled.

21. The funnel apparatus, according to claim 1, wherein said outer periphery of said main body member is diametrically opposite an outer periphery of said main body member that is a midpoint between said pair of adjustable stabilizing legs.

* * * * *